US008832863B2

(12) United States Patent
Yang

(10) Patent No.: US 8,832,863 B2
(45) Date of Patent: Sep. 16, 2014

(54) SPORTS TAPING TIGHTS

(76) Inventor: Jae Young Yang, Seoul (KR)

( * ) Notice: Subject to any disclaimer, the term of this patent is extended or adjusted under 35 U.S.C. 154(b) by 217 days.

(21) Appl. No.: 13/337,804

(22) Filed: Dec. 27, 2011

(65) Prior Publication Data

US 2013/0160189 A1 Jun. 27, 2013

(51) Int. Cl.
*A41D 13/00* (2006.01)

(52) U.S. Cl.
USPC ..... 2/69

(58) Field of Classification Search
CPC ..... A41D 13/0015; A63B 21/0552
USPC ..... 2/69, 227, 69.5, 237, 67, 104, 115, 228, 2/311, 401, 78.3, 238
See application file for complete search history.

(56) References Cited

U.S. PATENT DOCUMENTS

| | | | | |
|---|---|---|---|---|
| 7,631,367 | B2 * | 12/2009 | Caillibotte et al. | 2/228 |
| 2004/0255358 | A1 * | 12/2004 | Ota et al. | 2/69 |
| 2008/0256691 | A1 * | 10/2008 | White et al. | 2/455 |
| 2008/0295230 | A1 * | 12/2008 | Wright et al. | 2/455 |
| 2011/0083246 | A1 * | 4/2011 | Vitarana | 2/69 |
| 2011/0209263 | A1 * | 9/2011 | Suzuki et al. | 2/67 |
| 2011/0209267 | A1 * | 9/2011 | Rush et al. | 2/228 |
| 2011/0302686 | A1 * | 12/2011 | Chapuis | 2/69 |
| 2012/0131720 | A1 * | 5/2012 | Nordstrom et al. | 2/69 |
| 2012/0174282 | A1 * | 7/2012 | Newton et al. | 2/69 |
| 2012/0210487 | A1 * | 8/2012 | Albin et al. | 2/69 |
| 2013/0212767 | A1 * | 8/2013 | Nordstom et al. | 2/69 |

FOREIGN PATENT DOCUMENTS

| | | |
|---|---|---|
| JP | 2006-118088 | 5/2006 |

* cited by examiner

*Primary Examiner* — Khoa Huynh
*Assistant Examiner* — Anna Kinsaul
(74) *Attorney, Agent, or Firm* — LaMorte & Associates P.C.

(57) ABSTRACT

Sports taping tights include multi-layered coats of silicone or urethane on sections in the front and back of arm muscle parts, front and back of shoulder muscle parts, the belly muscle parts, front and back of lower waist and buttock muscle parts, front and back of thigh and calf muscle parts, the front and back of ankle muscle parts and sections of knees in the inside or outside surface of the upper and lower halves of the tights applied by multi-step print coating to provide selective distribution of stronger fabric tension without necessitating cutting of main fabric, thereby maximizing the tightness of the contact of fabric with body, assisting and reinforcing the muscles and ligaments, enhancing the mobility of body, protecting and increasing the power of muscles and ligaments and protecting the body.

17 Claims, 12 Drawing Sheets

SPORTS TAPING TIGHTS

DETAILED DESCRIPTION OF THE INVENTION

1. Technical Field

The present invention is relating to the formation of tights for sports purpose, Sports Taping Tights, by applying multi-layer printing or coating of silicon (or urethane) on the inside and outside surfaces of each section of the tights, which are made with high elasticity fabric containing more than 40% spandex, along the lines of body muscles, without the need for incisions and seaming while tailoring.

2. Background Technology

Depending on the amount and types of physical exercise of the upper and lower halves of the human body, different set of muscles is more developed than others. Excessive workout and strenuous sports actions causes certain muscles to be fatigued quickly and may result in the sagging of the muscles leading to the dislocation of joints or pelvis. Therefore, addition of extra layers to the main fabric of the sports tights such as bodysuits, leotards and spats to enhance the tension in the muscular sections has been generally practiced since it provides muscle supporting function. The method of manufacturing tights by cutting out the pieces of main fabric and seaming them together has also been known widely and used in actual manufacturing.

Also, an invention of clothes with body shape correction function and muscle support function has been disclosed. It claims, "It is possible to offer the clothes made of a warp knitted fabric in which ground weave knitting consisting of jacquard knitting is constituted of non-elastic yarns and, in addition, elastic yarns are inserted and/or elastic yarns are knitted into the ground weave knitting; specifically, clothes with a body shape correcting function or a muscle supporting function made of a warp knitted fabric in which specified comparatively strong tensioning-force portions and comparatively weak tensioning-force portions are provided in a pattern form at specified locations by switching the knitted textile weave of the ground weave knitting according to a strong or weak tensioning force requirement to change a textile weave, wherein a step, which is likely to affect the outer wear to deteriorate the outer appearance of the wearer, is eliminated at the boundary between portions with different tensioning forces." However, the description that knitted fabric is formed so that comparatively strong tensioning-force portions and comparatively weak tensioning-force portions are provided in a pattern form wherein a step is eliminated at the boundary is confusing.

There are also other inventions disclosed: Japanese Disclosed Patent Notice 2006-118088 on 'Muscle Protection Reinforced Clothes'; Foreign Patent with KPA #527561 on "Garments".

The former is relating to: "Muscle protection reinforced clothes free from requiring much labor and time in work of sticking a restraining stretch material to the main body thereof and suitable for mass production. In summary, the muscle protection reinforced clothes (1, 2) has the restraining stretch material (S, S1~S7) attached to the prescribed position of the clothes main body (C) made of a stretch fabric. The restraining stretch material made of a rubber material stuck to the main body (C) by printing and the rubber material is made of silicone rubber." It is structured with a number of V shapes print-coated in arm and thigh sections of the clothes.

The latter is presented with the summary stating; "A garment (10C) which covers at least part of the lower half of the body, has a thigh portion, is worn by being fitted to the human body, consists of a stretchable material, and partially has a strongly tightening portion (1), wherein the strongly tightening portion (1) consists of a compressively tightening unit (A) that has right and left portions joined together at the position (2) on the garments rear side corresponding to any portion of a zone extending from a sacrum to a lumbar vertebra of the human body, and that covers a portion starting at the position (2), extending approximately along the muscle fibers of right and left greatest gluteal muscles; passing the swelling apexes of a hip or the vicinities thereof and reaching at least the vicinities of greater trochanters. The garment improves the stability of hip joints, eases the anteflexion of a lumbar vertebra, produces a youthful physique/posture, contributes to easing of lumbago and other pains, and has a useful function leading to tumbling prevention for the aged." However, both have localized sections with single-layer print coat where clothe make partial contact with body and compressively tightening sections with 1, 2, or 3 layers of reinforcing fabric.

In the present invention, the purpose is to present tights with body shape correction function and muscle support function that do not require the use of reinforcement with 1, 2, or 3 layers of additional fabric but have tightness of contact with body improved by means of multi-layer multi-step print coating on certain sections along the lines of body to improve the wearing comfort, maximize mobility and increase the durability and productivity of the products through simplified tailoring and processing procedures.

DESCRIPTIONS OF THE INVENTION

Technical Problems that the Invention Intends to Solve

Present invention was developed taking into account the above considerations and its purpose is to present tights that are suitable for use by athletes whose activities involve movement which are considered excessive for normal life or for ordinary people, to prevent degradation of mobility due to elongation or loss of elasticity during exercise, to maximize muscle poer by supporting its activation and improve comfort of wearing and mobility by improving the tightness of contact with body with multi-layer, multi-step print coating of silicon or urethane on the inside and outside surface of main fabric.

Method of Solving the Problem

The tights of this invention can solve the above problem by rendering comfort of wearing by creating tight contact with the body surfaces where repetitive muscular contractions occur, ensuring that the entire sections of the skin surface of the muscles which undergo repetitive muscular contractions depending on the state of exercise activities, making them suitable for use in performing strenuous exercises such as yoga, aerobic, skateboarding, ballet, water skiing and snow skiing, preventing dislocation of pelvic bone, joints or cartilages and producing the effects of muscle support, improved muscle performance, muscle rehabilitation, body shape correction as well as maintaining the elasticity of sagging skin and muscles.

Effects

The tights of this invention address the shortcomings and fundamentally solve the problems of sports tapings or cut-and-seam products or the addition of 1 to 3 layers of additional fabric to the elastic main fabric, which are not sufficient for maximizing the performance of muscles and ligaments of youths, athletes, elderly and ordinary people. The tights of this invention are effective in enhancing the muscular performance of body during exercise than usual as well as preventing the injury because they have the effects of mobility improvement, muscle protection, muscular power improvement and body protection when they are worn during exercise by elderly, or weak people, those whose mobility has been impaired by injury in a muscle or a ligament as well as by athletes.

BRIEF DESCRIPTIONS OF DRAWINGS

Figure 11:
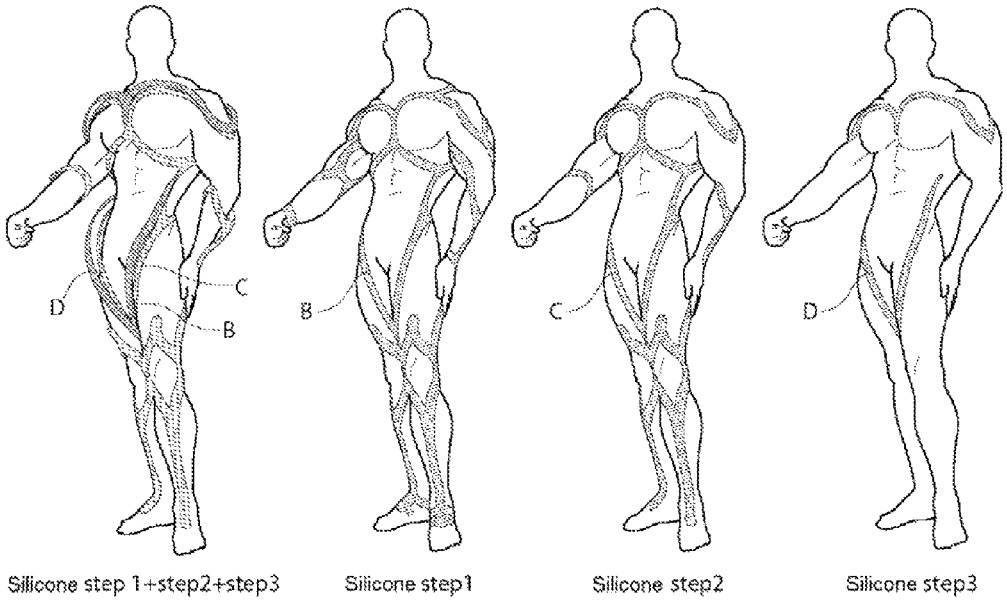

FIG. 11 is an illustrative view showing the order of multi-step printing of the step 1 (B), step 2 (C) and step 3 (D) coatings on the main fabric surface along the lines of muscles and the combined state of the front side of this invention.

Figure 12:
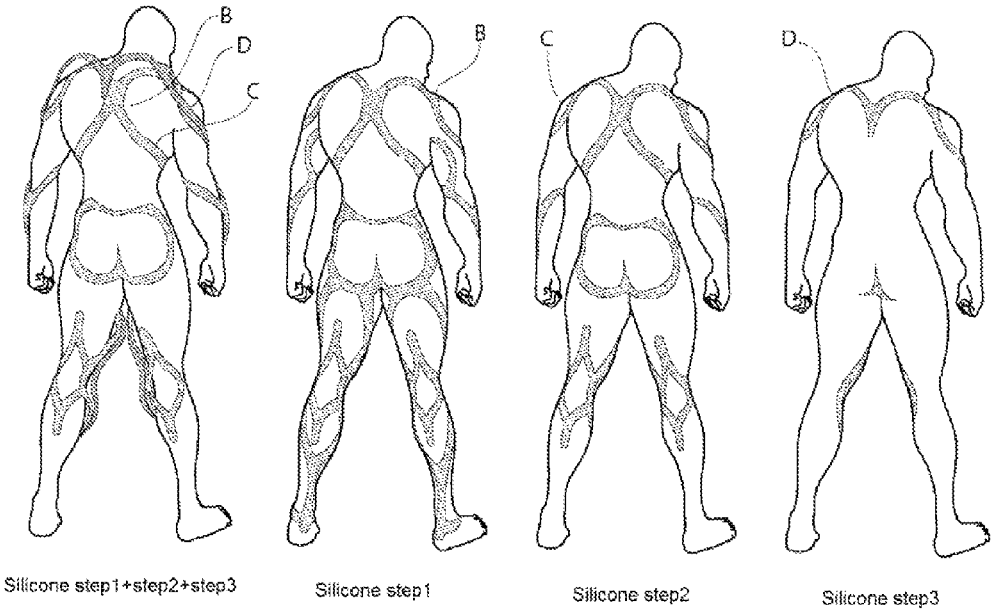

FIG. 12 is an illustrative view showing the order of multi-step print coatings on back side of this invention.

Figure 13:
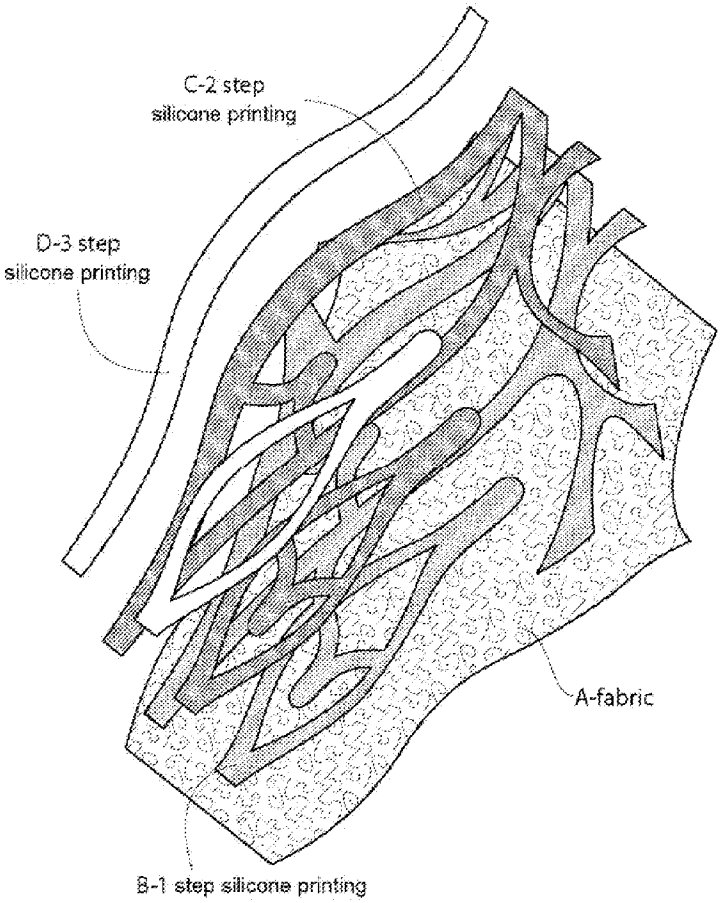

FIG. 13 is an enlarged illustrative view showing the process of multi-layer, multi-step printing of silicon of different thickness for different parts of the lower half of this invention.

Figure 14:
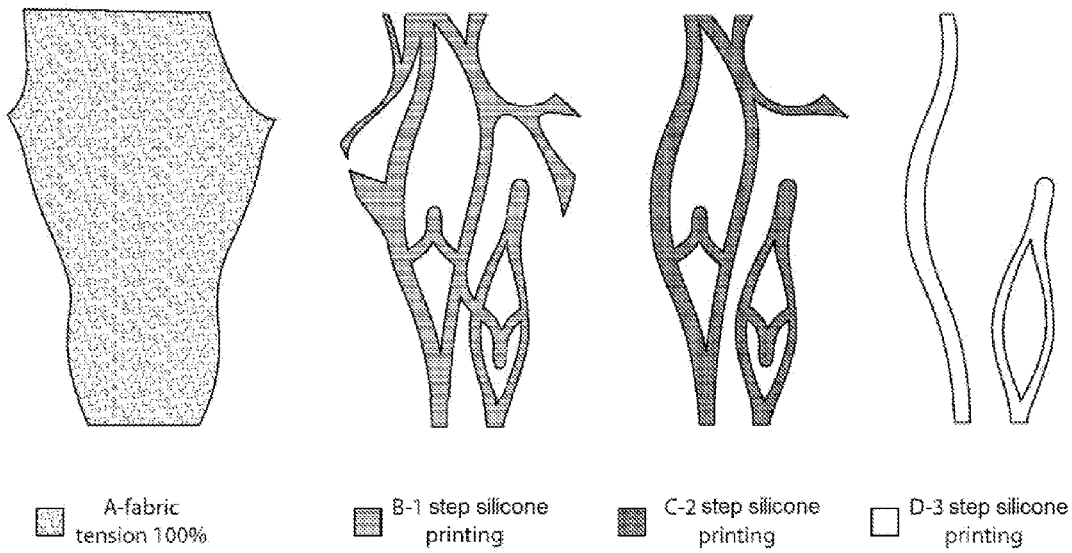

FIG. 14 is an illustrative view showing the order of printing steps shown in FIG. 13.

Figure 15:
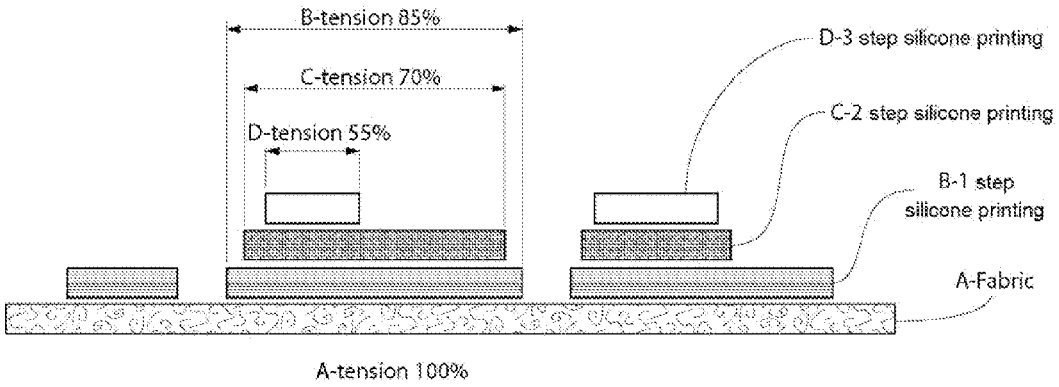

FIG. 15 is an illustrative view showing the tension for each printing step shown in FIG. 13.

DETAILED DESCRIPTIONS FOR EMBODIMENT OF THE INVENTION

Figure 1:
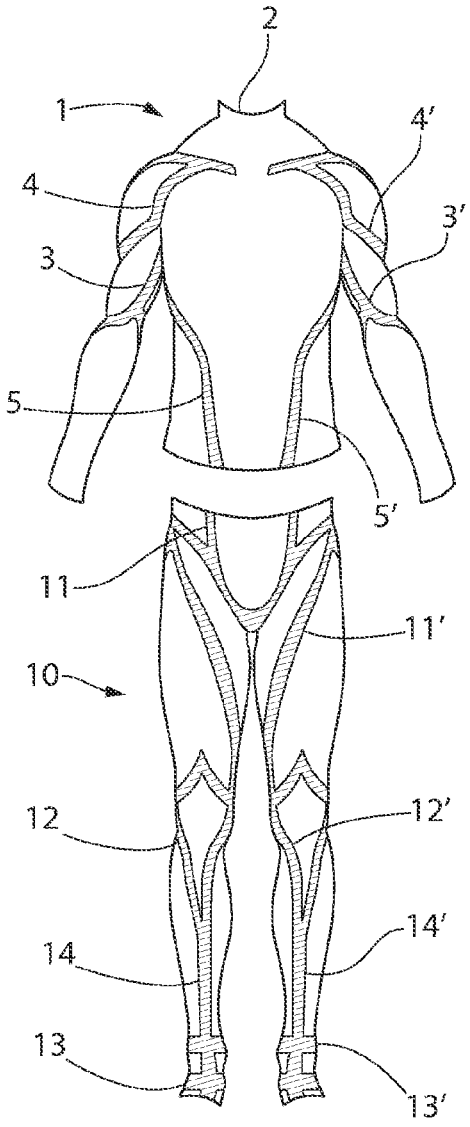
FIG. 1 is an illustrative view showing the print coating sections on the front side of the upper and lower halves of this invention.

Detailed descriptions with Figures about the examples of the actions of the sports taping tights of the present invention are as follows:

FIG. 1 is an illustrative view showing the layout of the print coating sections on the front side of the upper and lower halves of the tights of this invention. It shows the multi-layer, multi-step silicon coatings printed in step 1, 2 and 3 on the parts that come into contact with arm muscle parts, shoulder and belly muscle parts, thighs, crotch, knees and shins.

Figure 2:
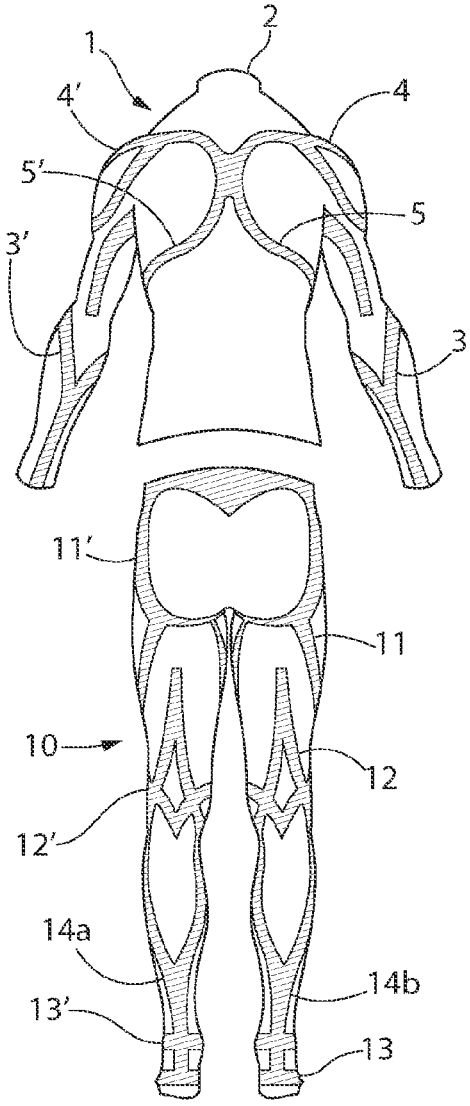
FIG. 2 is an illustrative view showing the print coating sections on the back side of the upper and lower halves of this invention.

FIG. 2 is an illustrative view showing the layout of the print coating sections on the back side of the upper and lower halves of the tights of this invention. It shows multi-layer, multi-step silicon coatings of different area sizes printed in step 1, 2 and 3 on different parts that come into contact with arm muscle parts, shoulder muscle parts, hips and back thighs, calves and ankles.

Figure 3:
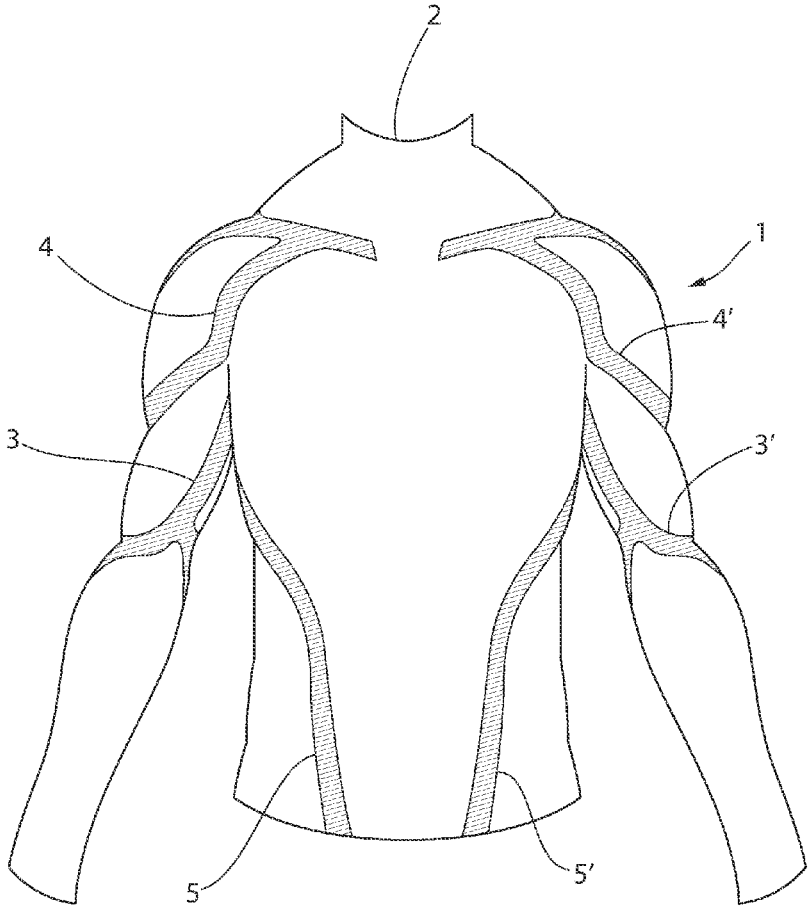
FIG. 3 is an enlarged illustrative view showing the print coating sections on the front side of the upper half of this invention.
Figure 4:
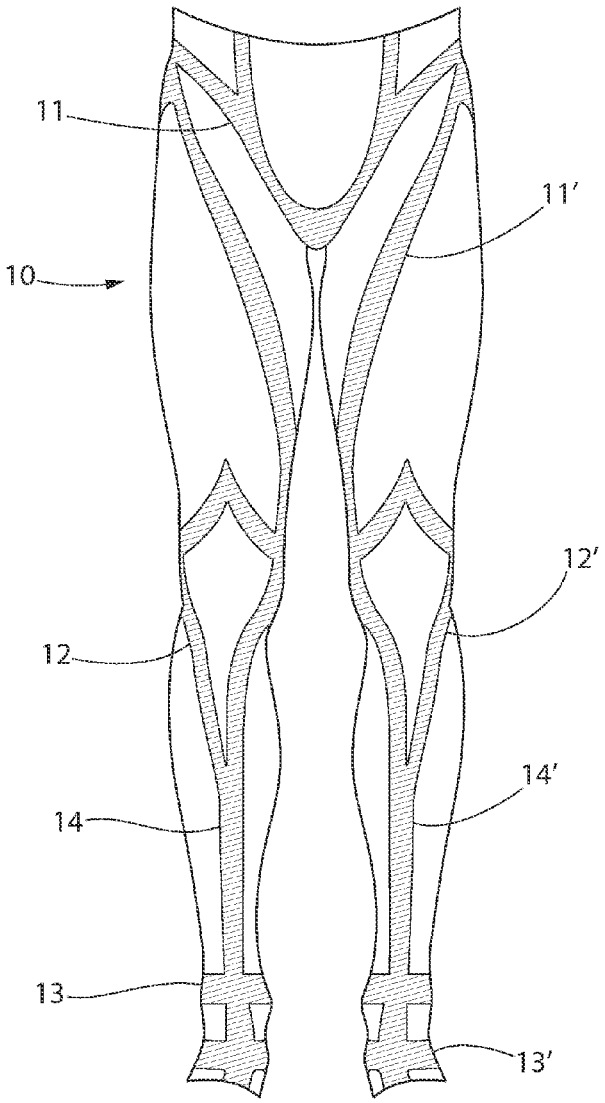
FIG. 4 is an enlarged illustrative view showing the print coating sections on the front side of the lower half of this invention.

FIG. 3 and FIG. 4 are enlarged illustrative views of FIG. 1, showing the muscle parts of the upper half of the tights (1) that are coated with silicon and urethane forming the step 1, 2 and 3 layers of multi-layer, multi-step coating.

Figure 5:
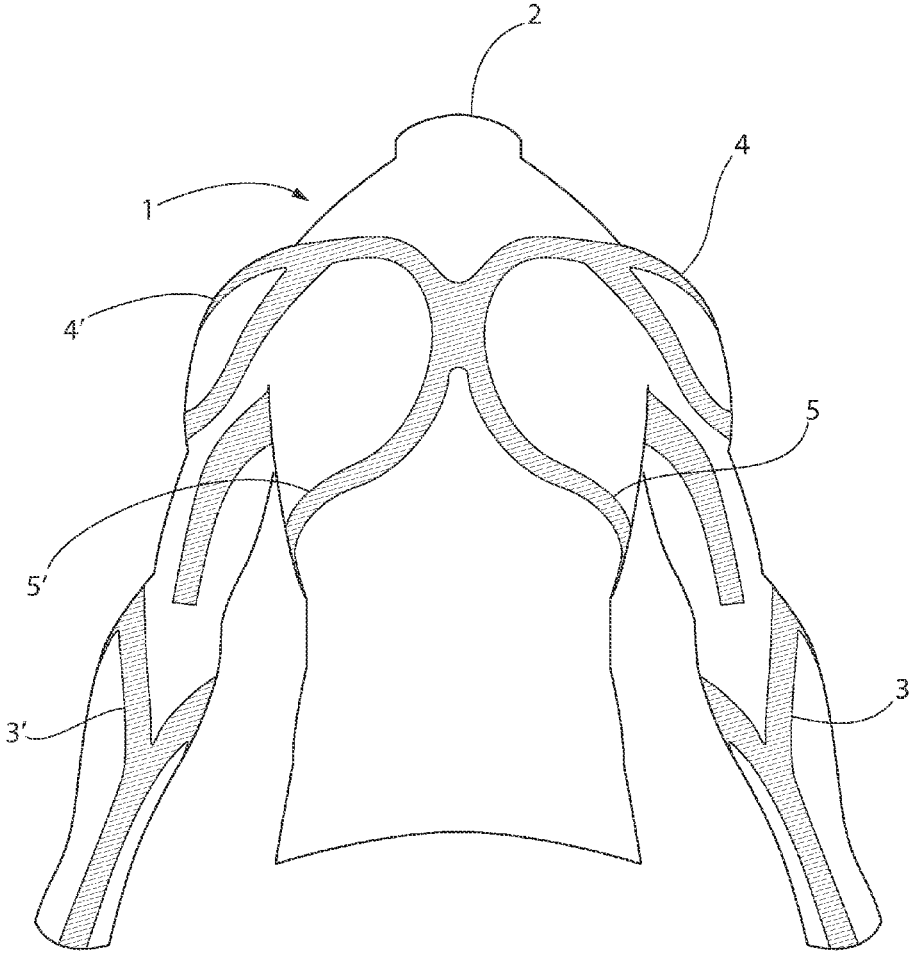
FIG. 5 is an enlarged illustrative view showing the print coating sections on the back side of the upper half of this invention.
Figure 6:
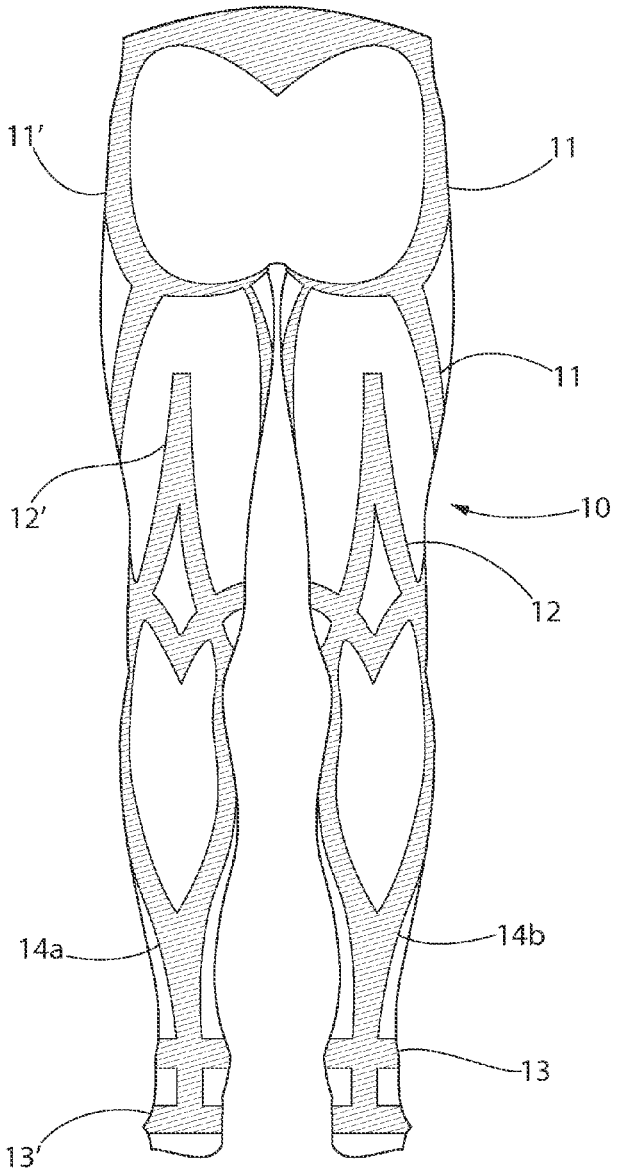
FIG. 6 is an enlarged illustrative view showing the print coating sections on the back side of the lower half of this invention.

FIG. 5 and FIG. 6 are enlarged illustrative views of FIG. 2, showing the muscle contact parts of the lower half of the tights coated with silicon and urethane forming the step 1, 2 and 3 layers of multi-layer, multi-step coating.

Figure 7:
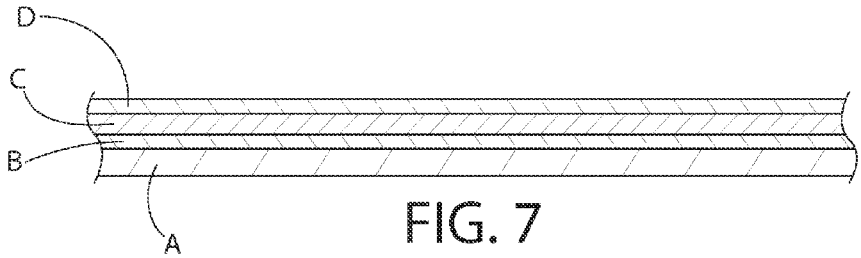
FIG. 7 is an enlarged sectional view showing the print coating sections in the line of muscles on inside surface of the main fabric of this invention.
Figure 8:
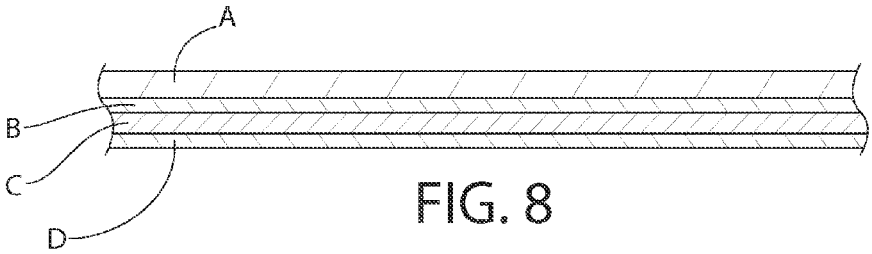
FIG. 8 is an enlarged sectional view showing the print coating sections in the line of muscles on outside surface of the main fabric of this invention.

FIG. 7 and FIG. 8 are enlarged sectional views showing the surface of main fabric (A) and appropriate parts of the inside and outside surfaces of main fabric coated with urethane and silicon forming the step 1 (B), step 2 (C) and step 3 (D) layers of multi-layer, multi-step coating for added elasticity.

Figure 9:
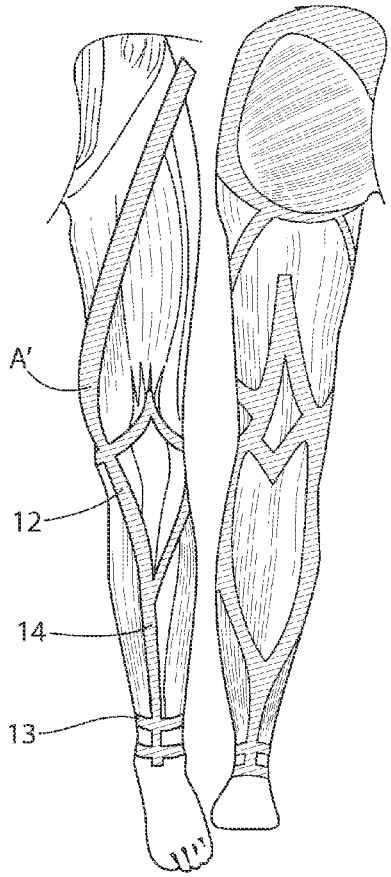
FIG. 9 and FIG. 10 are enlarged illustrative views showing the print coating sections on the cut and spread front side and back side of the lower half of this invention.
Figure 10:
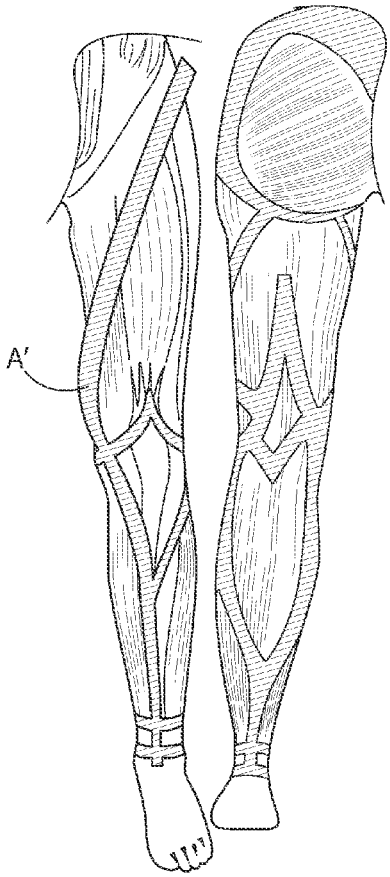

FIG. 9 and FIG. 10 are enlarged illustrative views showing the front side and back side of the lower half of the tights where the parts with print coating of urethane and silicon on the main fabric of the tights (10) along the lines of muscles are overlapped after forming the tights (10) for better view.

FIG. 11 and FIG. 12 are illustrative views of the front side and back side, showing the order of multi-step printing of the step 1 (B), step 2 (C) and step 3 (D) coatings on the main fabric surface along the lines of muscles and the combined state (in contact with respective muscle parts of the body).

FIG. 13 is an enlarged illustrative view showing the process of multi-layer, multi-step printing of silicon of different thickness for different parts of the lower half of the tights of the present invention.

FIG. 14 is an illustrative view showing the separate illustration of each step of the combined state shown in FIG. 13.

FIG. 15 is an illustrative view showing the separate illustration of tension for each step of the combined state shown in FIG. 13.

Then sports taping tights of the present invention use elastic resin and rubber materials, silicon and urethane, to print coat on the inside (FIG. 7) and outside (FIG. 8) surface of highly elastic fiber (A). Coating is done in multiple steps of step 1 (B), step 2 (C) and step 3 (D) coating on the cut fabric of the upper and lower halves of the tights. Coating is done in multiple steps creating multiple layers and single to triple print coating is ideal. However, more than three coatings, or even more than 10 coatings is possible but too many coatings has shortcomings of too strong elasticity. Compared with tights manufactured with conventional cut-and-seam method or single coating, creating different layers (1-layer, 2-layer, or 3-layer) of coatings with different tensions on different parts with up to three coatings allows detailed and effective distribution of the tension of main fabric (A), raising the tightness of contact with body and maximizing the muscle support effect during exercising, The 'Muscle Protection Reinforced Clothes' disclosed by the Japanese Patent Disclosure Notice employs multiple V-shape printing on limited muscle parts including arms, wrists, thighs and knees and they are expensive, less effective and inefficient and their comfort of wearing and tightness of contact are inferior. On the other hand, the present invention has semi-permanent durability with undiminished elasticity because it employs multi-layer, multi-step silicon coating of 0.2 mm-2 mm thickness on main fabric along the entire lines of muscles allowing tight contact of high elasticity main fabric and silicon coating with entire body.

The characteristics are that, after cutting the main fabric for upper half (1) and lower half (10) of the tights, tights are formed after applying multi-layer, multi-step (B) (C) (D)

print coatings on the locations in the front side (FIG. 1) and back side (FIG. 2) of the upper and lower halves of the tights (1) (10) along the lines of the muscles that correspond with the coating sections in the front and back side of arm muscle parts (3) (3'), the coating sections in the front and back side of shoulder muscle parts (4) (4'), the coating sections in the belly muscle parts (5) (5'), the coating sections in the front and back side of lower waist and buttock muscle parts (11) (11'), the coating sections in the front and back side of thigh and calf muscle parts (12) (12'), the coating sections in the front and back side of ankle muscle parts (13) (13') and the protective coating sections of knees (14) (14').

When multi-step ((A) (B) (C), multi-layer (3-layer) print coating is created on the entire lines of the muscles on the above upper and lower halves of the tights (1) (10), it is done on the inside (illustrative view in FIG. 7) or outside surface (illustrative view in FIG. 8) of the above main fabric (A) (A'). Overlapping of coating in any part of the inside or outside surface of the main fabric (A) (A') do not change the muscle support function or the power of protection by preventing ligaments from dislocation or damage but produce significantly more flexibility and elasticity. FIG. 13 is an enlarged illustrative view showing the process of multi-layer printing of silicon of different thickness for different parts of the lower half of the tights.

FIG. 14 is an illustrative view showing the order of printing with separate illustration of each step of the combined state shown in FIG. 13. FIG. 15 is an illustrative view showing the tension for each step.

FIG. 9 and FIG. 10 are illustrative views showing the front side and back side of the muscle parts (red) in the entire lines of muscles in the lower half of body and the cut and spread image (white lines) of one (leg) side of main fabric (A) constituting the lower half of the tights (10) and illustrating how the coating sections in the front and back side of lower waist and buttock muscle parts (11) (11'), the coating sections in the front and back side of thigh and calf muscle parts (12) (12'), the coating sections in the front and back side of ankle muscle parts (13) (13'), the protective coating sections of knees (14) (14') and coating sections in the back side of knees (14*a*) (14*b*) of main fabric (A') for the lower half of the tights are print—coated (blue) in multiple layers on the corresponding parts in main fabric (A), by displaying the overlapping image of coating parts which are positioned at the corresponding muscle parts of the lower body. When the main fabric (A') constitutes the lower half of the tights together with the above leg part, the print coating sections will make contact with the corresponding muscle parts.

FIG. 11 and FIG. 12 are illustrative views showing the order of multi-step print coatings showing how the multi-step (step 1, 2 and 3), multi-layer print coat of silicon on the parts, that actually make contact with body when the tights (1) (10) are worn, are put together in three steps as shown in the illustration on the left. FIG. 11 shows an illustrative view of multi-step coating positions on the front surface and FIG. 12 shows an illustrative view of multi-step coating positions on the back surface.

The coating sections in the front and back side of arm muscle parts (3) (3'), the coating sections in the front and back side of shoulder muscle parts (4) (4') and the coating sections in the belly muscle parts (5) (5'), which are shown in FIG. 3 and FIG. 5 illustrating the front and back sides of the upper half of the tights (1), are print-coated in multi-step (B) (C) (D) and multi-layer so that front and back sides are all connected.

As shown in FIG. 9 and FIG. 10, after cutting the main fabric (A) for upper half (1) of the tights, multi-step, multi-layer print coatings are also applied to the parts which come into contact with front and back muscle parts of the upper half of body, and tights are formed by combining the high elasticity main fabric and high elasticity silicon to reinforce and support muscles and ligaments during exercise and sports activities, which is achieved by the multi-step, multi-layer print-coats of silicon and urethane, (3)(3') (4) (4') (5) (5'), (11) (11') (12) (12') (13 (13') (14) (14') (14*a*) (14*b*) that reinforce the compressive force of muscles of body improving body mobility and protecting muscles and body much effectively than the conventional products.

The sports taping tights of the present invention employ different thickness of multi-step, multi-layer print coating of silicon and urethane rubber material on the outside or inside surface of high-elasticity main fabric (A) (A') to protect and reinforce all the muscles and ligaments of human body.

When these tights are worn by weak individuals, athletes, ordinary people, or by those who have limited mobility because of the injury to a muscle or a ligament during exercise or sports activities, they support and reinforce the muscles and ligaments producing the effect of muscle protection, ligament protection, improvement of muscle power and body protection. Also, compared with the effect of the sports taping clothes with strongly tightening portion described in the KPA Patent #10-527561 on 'Garments', the tights of the present invention are formed with multiple step (B) (C) (D), multiple layers that directly reinforce muscles and ligaments 2-3 times more strongly and, when they are used by young athletes whose muscle are not yet fully developed, they improve the mobility and prevent injury. They can also be used as medical supplement when they are worn by adults while enjoying sports and leisure, by providing strong support as well as compressive and tightening force to body muscle, preventing sagging of muscles and ligaments and correcting the dislocation state of joints and pelvis. They can also be used for body shape correction, for swimming, athletic sports, ballgames, ballet, yoga, as well as for specific muscle and joints. They can be used either as a whole-body wear or as apart wear for specific purposes according to the taping graphic for neck, shoulder, arm, elbow, forearm, wrist, back, waist, pelvis, thigh, knee, shin, ankle, etc.

SYMBOLS FOR MAJOR PARTS USED IN DRAWINGS

1: Upper half of tights
2: Neck part
3, 3': Coating sections in the front and back side of arm muscle parts
4, 4': Coating sections in the front and back side of shoulder muscle parts
5, 5': Coating sections in the belly muscle parts
10: Lower half of tights
11, 11': Coating sections in the front and. back side of lower waist and buttock muscle parts
12, 12': Coating sections in the front and back side of thigh and calf muscle parts
13, 13': Coating sections in the front and back side of ankle muscle parts
14, 14': Protective coating sections of knees
14*a*, 14*b*: Coating section of the back side of knees
A: Main fabric
A': Outline of the spread main fabric for lower half of tights
B, C, D: Cross section of coating in step 1, 2 and 3 respectively In example multi-step, multi-layer silicon coating of silicon (urethane)

FIG. 11.
Combination of silicon—step 1+step2+step3
Silicon—Step 1
Silicon—Step 2 silicon
Silicon—Step 3
FIG. 12.
Combination of silicon—step 1+step2+step3
Silicon—Step 1
Silicon—Step 2 silicon
Silicon—Step 3
FIG. 13
A—Main fabric
B—Silicon print—Step 1
C—Silicon print—Step 2
C—Silicon print—Step 3 (and beyond)
FIG. 14.
A—Main fabric
Tension stretching 100%
B—Silicon print—Step 1
C—Silicon print—Step 2
D—Silicon print—Step 3 (and beyond)
FIG. 15.
B—Tension 85%
C—Tension 70%
D—Tension 55%
A—Tension 100%
B—Silicon print—Step 1
C—Silicon print—Step 2
D—Silicon print Step 3 (and beyond)
A—Main fabric

What is claimed is:

1. A garment, comprising:

panels of a base fabric sewn into a garment, wherein at least one of said panels is selectively reinforced with elastic material; and said elastic material including a first layer of elastic material printed directly onto said base fabric in a first pattern and with a first thickness, wherein said first layer of elastic material is printed onto said base fabric while said base fabric is stretched at a first tension, and a second layer of elastic material printed directly onto said first layer of elastic material in a second pattern and with a second thickness, wherein said second pattern covers only a smaller part of said first pattern.

2. The garment according to claim 1, wherein said elastic material includes a third layer of elastic material printed directly onto said second layer of elastic material in a third pattern and with a third thickness, wherein said third pattern covers only part of said second pattern.

3. The garment according to claim 2, wherein said second layer of elastic material is printed onto said first layer of elastic material while said base fabric is stretched at a second tension, wherein said second tension is less than said first tension.

4. The garment according to claim 2, wherein said third layer of elastic material is printed onto said second layer of elastic material while said base fabric is stretched at a third tension, wherein said third tension is less than said first tension.

5. The garment according to claim 1, wherein said first thickness of said first layer of elastic material differs from said second thickness of said second layer of elastic material.

6. The garment according to claim 2, wherein said first thickness of said first layer of elastic material differs from said third thickness of said third layer of elastic material.

7. A garment, comprising:

at least one panel of a base fabric that is selectively reinforced with elastic material;

said elastic material including a first layer of elastic material applied to said base fabric in a first pattern and with a first thickness, wherein said first layer of elastic material is printed onto said base fabric while said base fabric is stretched at a first tension, a second layer of elastic material applied to said first layer of elastic material in a second pattern and with a second thickness, and a third layer of elastic material applied to said second layer of elastic material in a third pattern and with a third thickness, wherein said first pattern, said second pattern and said third pattern all differ.

8. The garment according to claim 7, wherein said elastic material is selected from a group consisting of silicone and urethane.

9. The garment according to claim 7, wherein said second pattern is applied to only parts of said first pattern.

10. The garment according to claim 7, wherein said third pattern is applied to only parts of said second pattern.

11. The garment according to claim 7, wherein said second layer of elastic material is printed onto said first layer of elastic material while said base fabric is stretched at a second tension, wherein said second tension is less than said first tension.

12. The garment according to claim 7, wherein said third layer of elastic material is printed onto said second layer of elastic material while said base fabric is stretched at a third tension, wherein said third tension is less than said first tension.

13. The garment according to claim 7, wherein said first thickness of said first layer of elastic material differs from said second thickness of said second layer of elastic material.

14. The garment according to claim 7, wherein said first thickness of said first layer of elastomeric material differs from said third thickness of said third layer of elastic material.

15. A method of reinforcing segments of a garment with elastic material, said method comprising the steps of:

printing a first layer of elastic material onto a base fabric in a first pattern and at a first thickness, the base fabric being stretched at a first tension while printing said first layer onto said base fabric;

printing a second layer of elastic material onto parts of said first layer of elastic material in a second pattern and at a second thickness; and printing a third layer of elastic material onto parts of said second layer of elastic material in a third pattern and at a third thickness, wherein said first layer of elastic material, said second layer of elastic material and said third layer of elastic material are selected from a group consisting of silicone and urethane.

16. The method according to claim 15, wherein said first pattern covers a larger area than does said second pattern and said second pattern covers a larger area than does said third pattern.

17. The method according to claim 15, wherein said first thickness, said second thickness and said third thickness all differ.

* * * * *